United States Patent [19]

Kaplan

[11] Patent Number: 4,871,295

[45] Date of Patent: Oct. 3, 1989

[54] MODULAR RANKINE CYCLE VAPOR TURBINE

[75] Inventor: Uri Kaplan, Rehovot, Israel

[73] Assignee: Ormat Turbines (1965) Ltd., Yavne, Israel

[21] Appl. No.: 744,245

[22] Filed: Jun. 13, 1985

Related U.S. Application Data

[62] Division of Ser. No. 486,498, Apr. 19, 1983, Pat. No. 4,537,032.

[51] Int. Cl.[4] ..... F01D 17/00

[52] U.S. Cl. ..... 415/94; 415/103; 415/155

[58] Field of Search ..... 415/94, 95, 101, 198.1, 415/205, 103, 96, 97, 155, 36, 38; 60/677

[56] References Cited

U.S. PATENT DOCUMENTS

| | | | |
|---|---|---|---|
| 992,566 | 5/1911 | Kemble | 415/37 |
| 1,018,667 | 2/1912 | Johnson | 415/95 |
| 3,300,974 | 1/1967 | Reed et al. | 60/677 |
| 3,391,539 | 7/1968 | Dimitroff, Jr. et al. | 60/662 |
| 3,408,045 | 10/1968 | Hart | 415/103 |
| 3,552,876 | 1/1971 | Updike | 415/205 |
| 3,828,814 | 8/1974 | Neumann et al. | 415/155 X |
| 3,880,549 | 4/1975 | Schrieken | 415/101 |

FOREIGN PATENT DOCUMENTS

| | | | |
|---|---|---|---|
| 113903 | 10/1941 | Australia | 415/103 |
| 2503493 | 7/1976 | Fed. Rep. of Germany | 415/101 |
| 378764 | of 0000 | France | 415/101 |
| 1279260 | 11/1961 | France | 415/198.1 |
| 428355 | 5/1935 | United Kingdom | 415/95 |
| 580933 | 9/1946 | United Kingdom | 415/101 |
| 927207 | 5/1963 | United Kingdom | 415/103 |
| 1219994 | 1/1971 | United Kingdom | 415/101 |

*Primary Examiner*—Robert E. Garrett
*Assistant Examiner*—Joseph M. Pitko
*Attorney, Agent, or Firm*—Sandler & Greenblum

[57] ABSTRACT

A Rankine cycle power plant includes a plurality of vapor turbine modules, each having a shaft rotatably mounted in a housing, and a pair of axially spaced discs coupled together and mounted on the shaft for rotation therewith. Axial flow turbine blades are mounted on the periphery of each disc such that the blades on one disc are spaced from the blades on the other disc thus defining an annular space in the housing within which a circular nozzle ring is located, the ring having a plurality of nozzles that open toward the blades on each disc for directing vapor in opposite axial directions into the blades on each disc.

5 Claims, 3 Drawing Sheets

MODULAR RANKINE CYCLE VAPOR TURBINE

This is a division of application Ser. No. 486,498 filed Apr. 19, 1983, now U.S. Pat. No. 4,537,032.

DESCRIPTION

1. Technical Field

This invention relates to a multistage modular Rankine cycle turbine with improved control for variable load conditions.

2. Background Art

U.S. Pat. No. 992,566 discloses a steam turbine having a high pressure stage and a number of low pressure stages each of which is supplied, in parallel, with steam exhausted from the high pressure stage. According to the patentee, higher loads can be accomodated without changing the radial and circumferential dimensions of the low pressure stages, each of which is identical, by increasing within limits, the number of such stages. Each stage of the turbine is provided with many nozzles that can be connected selectively to a heat source thereby providing very fine incrementation of the work output of the turbine.

The design shown in the '566 patent is not suitable for use with a power plant operating on low grade heat because the working fluid in this patent is water. When only low grade heat is available, the size of the turbine becomes so large as to be impractical. The problem of turbine size, when a low grade is available, is solved by utilizing a high molecular weight organic fluid, as the working fluid. Turbines operating on the Rankine cycle using organic working fluids are commercially available from Ormat Turbines Ltd. They are available in sizes ranging from 300–3000 W and are conventionally use to power repeater stations as part of a telecommunication network and for other relatively low power requirements where high reliability in both start-up and operation is a mandatory.

Rankine cycle turbogenerators operating with organic working fluids are ideally suitable for use with low grade heat sources such as waste heat, geothermal sources, and solar ponds. Typically, a waste heat where solar pond installation may require from 0.75 MW to 5 MW of the electrical power. But scaling-up conventional power plants of the type described by three or more orders of magnitude to accommodate this substantial amount of power is difficult.

One approach to the design of Rankin cycle turbogenerator of the type described is merely to scale up the tubine and to multistage much as is done in conventional steam turbines. In such case, the exhaust of one turbine stage becomes the input to a succeeding turbine stage. Unfortunately, conventional multistaging of organic fluid results in a physically large and hence impractical low pressure turbine.

It is therefore an object for the present invention to provide a new and improved multistage, modular Rankine cycle turbine and means for controlling the same which permits economical construction of relatively large capacity organic fluid turbogenerators and their economical use.

BRIEF DESCRIPTION OF THE INVENTION

The method according to the present invention controls the load on a turbine of a Rankine cycle power plant wherein the turbine has a plurality of a modular units to which vaporized working fluid from a boiler is supplied in parallel through respective throttle valves, and from which exhaust vapor is removed in parallel. The method according to the present invention comprises controllig the operation of each throttle valve such that, under any load condition, only one throttle valve at a time is adjusted and all of the others are either fully open or fully closed. When the turbine is called upon to produce more work that can be supplied by single modular unit, the throttle valve of the single unit is adjusted while the throttle valve of the other units remain fully closed until the throttle valve of the single unit is fully open. Thereafter, the throttle valve of an other unit is opened and adjusted while the throttle valve of the one unit remains fully open. The converse of this arrangement is achieved when the turbine is called upon to produce less work than can be produced by two modular units.

BRIEF DESCRIPTION OF DRAWINGS

An embodiment of the invention is shown in the accompanying drawings wherein.

DETAILED DESCRIPTION

Figure 1:
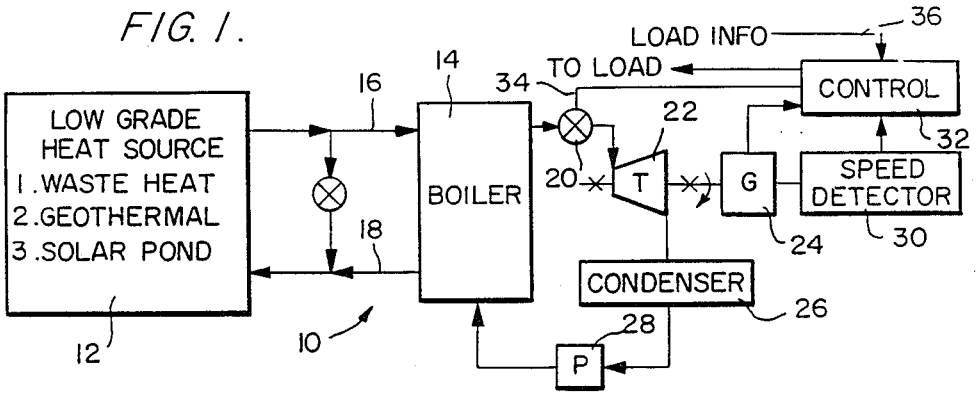
FIG. 1 is a block diagram of a conventional Rankine cycle power plant.

Referring now to the drawings, reference numeral 10 designates a conventional Rankine cycle power plant operating from low grade heat source 12 such as waste heat, geothermal source or solar pond. Fluid from heat source 12, typically at a temperature less than 100 deg. C., enters boiler 14 via inlet line 16, gives-up some of its heat to the working fluid in the boiler, and then is returned via exit line 18 to source 12. The working fluid in boiler 14 is an organic working fluid, typically Freon. In boiler 14, the working fluid is vaporized and applied through throttle valve 20 to Rankine cycle turbine 22 wherein the working fluid expands causing the turbine to rotate and produce work that drives generator 24 which produces electricity.

After expansion in turbine 22, the working fluid at a lower temperature and pressure is directed into condenser 26 which condenses the working fluid into a liquid. The condensate is returned by pump 28 to boiler 14 thus completing the working fluid cycle.

To provide speed control for the turbine, the rotational speed of the turbine and generator (turbogenerator), typically mounted on a common shaft, or on two shafts that are coupled together for rotation at the same speed, is sensed by detector 30 in a conventional manner. The output of speed detector 30 is applied to a control 32 which senses an overspeed or underspeed condition of the turbogenerator and responds by applying a control signal via lead 34 to throttle valve 20 for the purpose of correcting the over or underspeed condition. Control 32 may also receive, via control line 36, information on the load requirements in order to effectively provide the power plant with the necessary controls.

The size of a low grade heat source varies from instllation to installation from a fraction of a megawatt to tens of megawatts so that it is very difficult for a manufacturer of power plants to establish standard sizes in variety, wide enough to satisfy many different, potential customers of power plants seeking to take advantage of low grade heat sources. Therefore, it is convenient, in terms of economy of size of components, and the manufacture, handling and flexiblity in design, installation and maintenance, to construct power plants in the type described in modules, typically 1.25 kW. Thus, a 5 MW power plant would require four turbine modules which would be connected by a single output shaft to a single generator in order to produce the required power. Each turbine module is mounted on a common shaft contained within a single housing. This arrangement is shown in FIG. 2 to which reference is now made.

Figure 2:
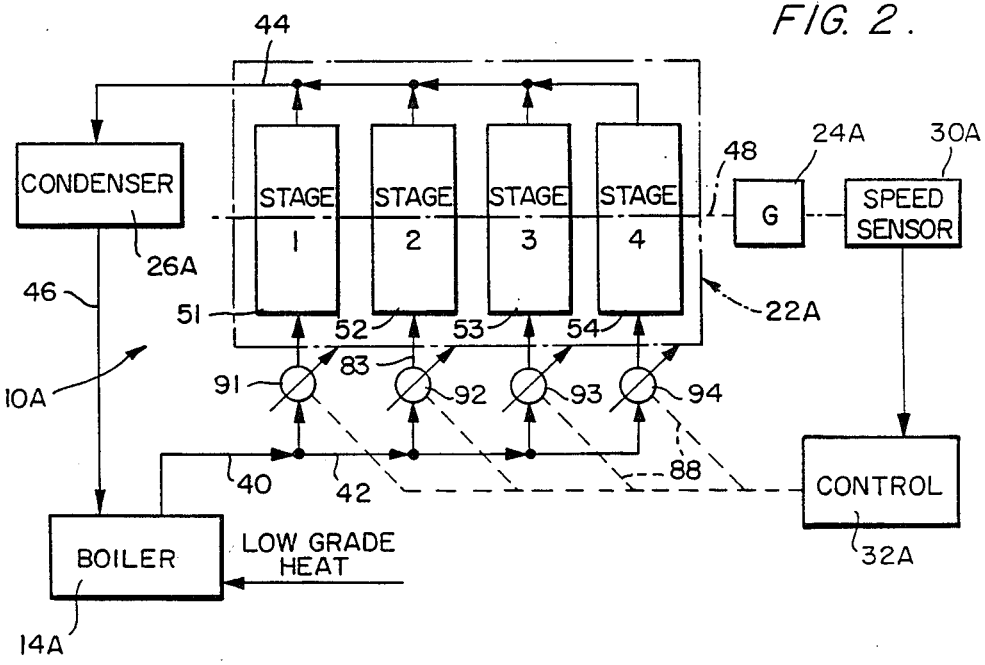
FIG. 2 is a schematic block diagram of a Rankine cycle turbogenerator showing control means for controlling the operation of the various throttle valves associated with the power plant.

In FIG. 2, an organic working fluid Rankine cycle power plant 10A, according to the present invention includes boiler 14A that delivers vaporized working fluid via inlet pipe 40 to inlet manifold 42 connected to turbine 22A. Power plant 10A also includes condenser 26A that receives working fluid from exhaust manifold 44 connected to turbine 22A and produces condensate that is returned via line 46 to boiler 14A. Output shaft 48 of the turbine is connected to generator 24A which is suitability connected (not shown) to an electrical load. Speed sensor 30A senses the rotation speed of the turbogeneraor and sends this information to control 32A which functions as described above to control the turbine speed.

Figure 3:
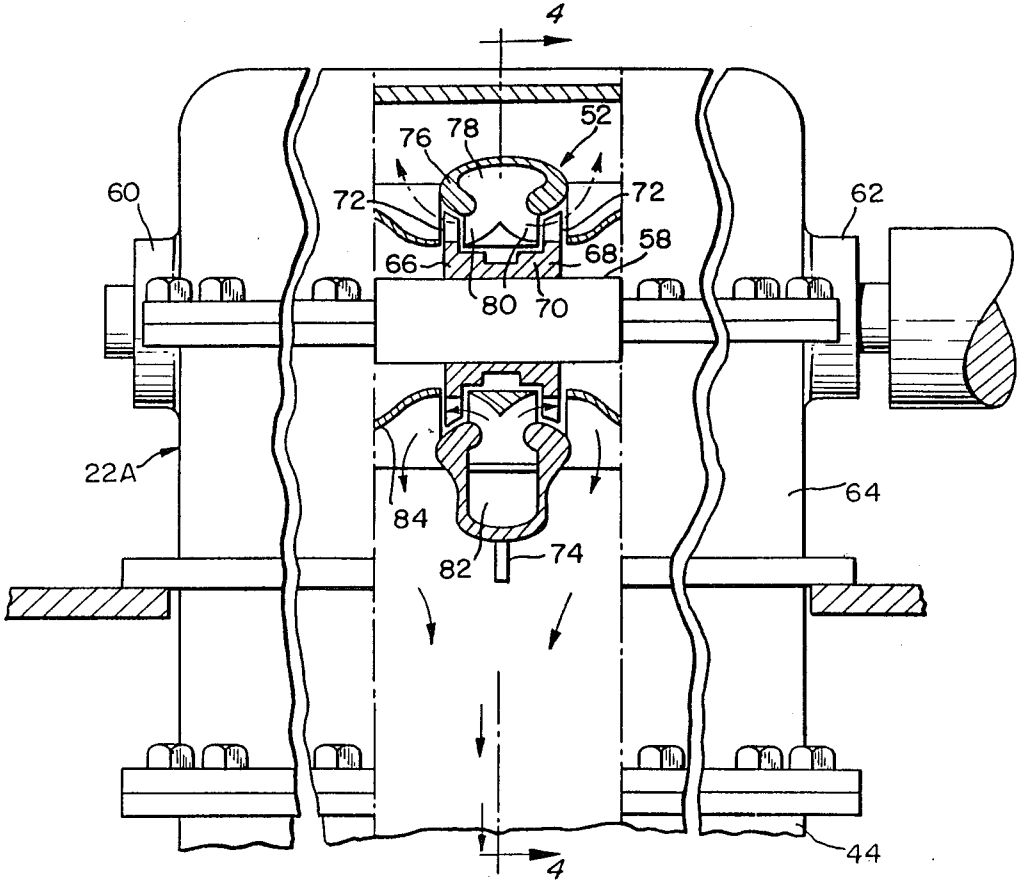
FIG. 3 is a side view of the turbine unit with parts broken away and shown in section for the purpose of illustrating the constructional details of a modular unit of the turbine, according to the present invention.

Turbine 22A comprises plurality of modular stages 51, 52, 53, 54, each of which is constructed in accordance with the details shown in FIG. 3. As shown therein, each modular unit has at least one axial flow stage, and preferably two axial stages.

Turbine 22A, as shown in FIG. 3, includes turbine shaft 58 rotatively mounted in bearings 60 and 62 located at the axial ends of housing 64 of the turbine. Mounted on shaft 58 are a plurality of modular units, such as units 51, 52, 53, 54 shown in FIG. 2. To facilitate the description, stage 52 is shown in FIG. 3. All of the other stages are identical so that the description of modular unit 52 will suffice for an understanding of the present invention.

Modular unit 52 has a pair of axially spaced discs 66, 68 and coupled together by hub 70 which is fixed to shaft 58 for rotation therewith. Each of discs 66 and 68 has a plurality of axial flow turbine blades 72 on the periphery of each disc. The blades on the discs of each unit are arranged in axial-counter-flow fashion so that the flow or working fluid through one set of blades is in an axial direction opposite to the axial direction in which flow through the other set of blades occurs. Fixed to housing 64 by support 74 is nozzle ring 76 defining annular chamber 78 that is fixed in the axial space between discs 66 and 68. Ring 76 is provided with a pluality of nozzles 80 that are directed axially in opposite directions from a central plane bisecting the planes of blades 72 on the discs. The nozzles are connected by annular region 82 so that working fluid entering inlet portion 83 (see FIG. 4) can flow within annular region 82, in spiral fashion, and can enter each of nozzles 80 which are distributed circumferentialy.

Fixed within housing 64 of the turbine are exhaust deflectors 84 located in the space between adjacent modular units. These deflectors are rigidly attached to housing 64 and served to direct the working vapor exhausted by the turbine modules into a central plenum chamber within the housing forming exhaust manifold 44.

Figure 4:
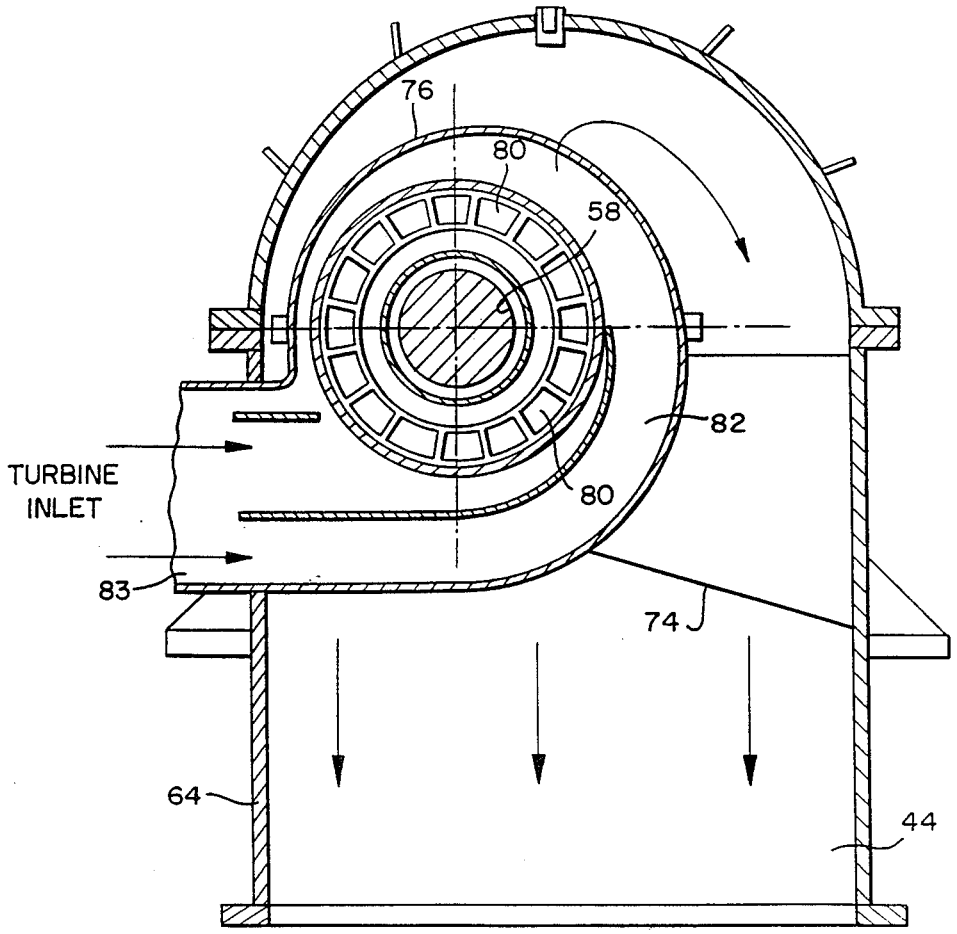
FIG. 4 is a vertical section through the turbine taken along the lines 4—4 of FIG. 3.

In operation, working fluid enters inlet 83, flows spirally through annular region 82 shown in FIG. 4, and enters nozzles 80 which are distributed circumferentially with respect to the turbine blades. Half of the fluid is distributed in one axial direction and pases through and interacts with the blades of one disc, and the other half of the fluid passes the opposite axial direction and interacts with the blades of the other disc. Deflectors 84 serves to direct the working fluid exhausted from the blades into chamber 44 which acts as an exhaust manifold as described previously.

Returning now to FIG. 2, each inlet 83 of the modular units is connected to individual throttle valve 91-94 by which the modular units are connected to inlet manifold 42. Each throttle valve 91 through 94 is separately controllable by control 32a as indicated by control lines 88 in FIG. 2. This arrangement is provided so that under partial load conditions, the vapor supplied by the boiler undergoes the least possible amount of throttling, thus optimizing the efficiency of turbine 22A. Each valve is actuated in a conventional manner by an electrical signal or hydraulic signal supplied by control 32A in accordance with the speed of shaft 88 as sensed by sensor 30A.

Figure 5:
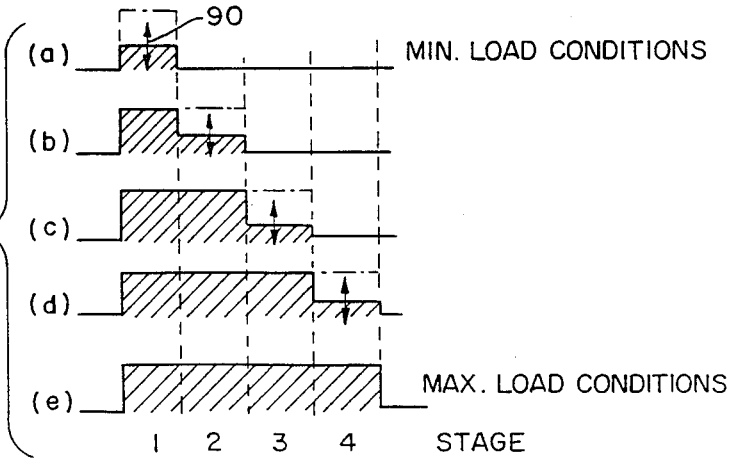
FIG. 5 is a chart that illustrates the manner in which the turbine is controlled by individually controlliing the throttling of each stage.

Control 32A operates valve in a manner illustrated in FIG. 5. That is to say, control 32A controls the operation of each valve 91–94 such that, under any load condition, only one throttle valve at a time is adjusted and all of the others are either fully open of fully closed. Under minimum load conditions, which is a situation when turbine 22A is being started, each of valve 92, associated with unit 52, valve 93 associated with unit 53 and valve 94 associated with unit 54 is closed; and only valve 91 associated with unit 51 is open and adjusted by control 32A. This is shown in upper line (a) of FIG. 5 where the ordinant of the curve represents the extent to which valve 91 is open. The cross-sectional area shown in FIG. 5 represents the load being supplied by the stage. Thus, as shown in line (a) of FIG. 5, unit 51 supplies only a portion of the possible load (shown by the claim line) it can supply. Control 32A operates to vary the load on the turbine and this variation is shown by arrow 90.

Control 32A continues to open valve 91 until, it is fully open. This is illustrated in line (b) where control 32A becomes effective to begin to open valve 92 as valves 93 and 94 remain closed, valve 91 remaining fully open. Control 32 continues to open valve 92 until unit 52 is producing all the power it can and valve 92 is fully open. When this occurs, as shown in line (c), valve 93 is opened and adjusted by control 32A as valves 91 and 92 remain fully open and valve 94 remains fully closed. The situtation is repeated as shown in line (d) until valve 93 is fully opened and adjusted by control 32A while valves 91, 92 and 93 remain fully open.

When generator 24A is other than a synchronous generator connected to an electrical grid, control 32A provides whatever control is necessary for the speed of turbine 22A by following the procedure shown in FIG. 5. That is to say, speed-up or slow-down of the turbine is achieved by adjusting only one throttle valve at a time while the other throttle valves remain either fully open or fully closed depending upon load conditions.

What is claimed is:

1. A turbine operable with an organic working fluid for driving a load comprising:

(a) a shaft rotatably mounted in a housing;

(b) a plurality of modular units each of which has a pair of axially spaced discs couples together and mounted on the shaft for rotation together;

(c) axial-flow blades on the periphery of each disc, the blades on the discs of each unit being arranged in axial-counter-flow fashion, such that each disc with its blades acts as a single-stage turbine;

(d) a nozzle ring for each unit supported by the housing and having an annular chamber that is fixed in the axial space between the discs of the unit, and having a plurality of nozzles that are directed toward the blades of the unit;

(e) deflectors in the housing between adjacent units for deflecting exhaust vapor exiting the blades of the units, the housing serving as the exhaust manifold of the turbine;

(f) a throttle valve associated with each nozzle ring for controlling the application of working fluid to said nozzle ring; and (g) a control responsive to the load on said turbine for controlling the throttle valves so that, under any load condition, only one of the throttle valves at a time is variable and all of the other throttle valves are either fully open or fully closed.

2. A parallel turbine unit operable with an organic working fluid comprising:

(a) a shaft rotatably mounted in a housing;

(b) a plurality of pairs of axially spaced discs coupled together and mounted on said shaft for rotation therewith;

(c) a set of axial flow blades on the periphery of each disc of a pair of discs, the facing radial edges of the blades in each set of blades of each pair of discs defining an axial space therebetween; and (d) a plurality of nozzle rings respectively located in the axial spaces, each nozzle ring having a plurality of nozzles directed toward the blades on a pair of discs for directing working fluid in opposite axial directions into the blades of a pair of discs;

(e) the sets of blades on each pair of discs being arranged in axial-counter-flow fashion so that the flow of working fluid directed through one of said sets of blades is in an axial direction opposite to the axial direction of flow through the other of said sets of blades;

(f) means for applying working fluid in parallel to each nozzle ring;

(g) said nozzle rings being concentric with the axis of the shaft, and being constructed and arranged to direct working fluid in a spiral direction about the axis of the shaft;

(h) a throttle valve associated with each nozzle ring for controlling the application of working fluid to said nozzle ring; and (g) a control responsive to the load on said tubine for controlling the throttle valves so that, under any load condition, only one of the throttle valves at a time is variable and all of the other throttle valves are either fully open or fully closed.

3. A parallel turbine according to claim 2 wherein said nozzle rings are concentric with the axis of the shaft.

4. A parallel turbine according to claim 2 wherein said nozzle rings are constructed and arranged to direct working fluid in a spiral direction about the axis of the shaft.

5. A Rankine cycle vapor turbine comprising:

(a) a plurality of vapor turbine modules, each having a shaft rotatably mounted in a housing;

(b) each module including a pair of axially spaced discs coupled together and mounted on the shaft of the module for rotation therewith;

(c) each module including a plurality of axial flow turbine blades mounted on the periphery of each disc of the module such that the blades on the respective discs of a module are axially spaced and define an annular space in the housing associated with the module;

(d) each module having a circular nozzle ring located in the annular spce associated with each module, the ring having a plurality of nozzles that open toward the blades on each disc of the module for directing vapor in opposite axial directions into the blades on each disc of a module; and (e) means supplying vapor to the nozzle ring of each module for minimizing throttling of said vapor, said means for supplying vapor includes a throttle valve operatively associated with the nozzle ring of each module, and control means constructed and arranged so that, under anay load condition, only on throttle valve at a time is adjustable and all the others are either fully open or fully closed.

* * * * *

UNITED STATES PATENT AND TRADEMARK OFFICE

CERTIFICATE OF CORRECTION

PATENT NO. : 4,871,295

DATED : October 3, 1989

INVENTOR(S) : Uri KAPLAN

It is certified that error appears in the above-identified patent and that said Letters Patent is hereby corrected as shown below:

Col. 6, line 25, change ", each having" to --mounted on --;
lines 28-29, delete "of the module"; and
lines 44, change "includes" to ---including---.

Signed and Sealed this

Twenty-third Day of October, 1990

*Attest:*

HARRY F. MANBECK, JR.

*Attesting Officer*

*Commissioner of Patents and Trademarks*